United States Patent [19]

Kossett

[11] 4,050,667

[45] Sept. 27, 1977

[54] TUBE MOLD

[75] Inventor: Allen J. Kossett, Libertyville, Ill.

[73] Assignee: Will Ross, Inc., Milwaukee, Wis.

[21] Appl. No.: 635,683

[22] Filed: Nov. 26, 1975

[51] Int. Cl.[2] ..... B22C 9/24; A61M 25/00; B29F 1/00

[52] U.S. Cl. ..... 249/82; 249/144; 128/348; 264/328; 264/334; 249/177

[58] Field of Search ..... 249/74, 75, 82, 124, 249/136, 144–148, 151, 158, 177, 82, 94, 175; 425/403, DIG. 10, 182, 249; 128/349 B, 348; 264/334, 328

[56] References Cited

U.S. PATENT DOCUMENTS

| | | | |
|---|---|---|---|
| 2,633,812 | 4/1953 | Myers | 249/74 |
| 2,653,370 | 9/1953 | Hoopes | 249/144 |
| 2,686,951 | 8/1954 | Seaman | 249/144 |
| 2,802,404 | 8/1957 | Taylor | 249/144 |
| 3,028,630 | 4/1962 | Walker | 249/144 |
| 3,229,615 | 1/1966 | Rattner | 249/151 |

FOREIGN PATENT DOCUMENTS

| | | | |
|---|---|---|---|
| 1,222,834 | 8/1966 | Germany | 249/144 |
| 7,112,911 | 2/1971 | Japan | 249/144 |

*Primary Examiner*—Francis S. Husar
*Assistant Examiner*—John S. Brown
*Attorney, Agent, or Firm*—John A. Dhuey

[57] ABSTRACT

A molding apparatus is described having a body portion with a mold cavity therein and a core means within said cavity having a core follower thereon which is designed to move along the core during the molding operation. Utilization of the core follower permits rapid and accurate formation of multiple lumen tubes, particularly those having arcuate shapes.

7 Claims, 9 Drawing Figures

FIG. 2
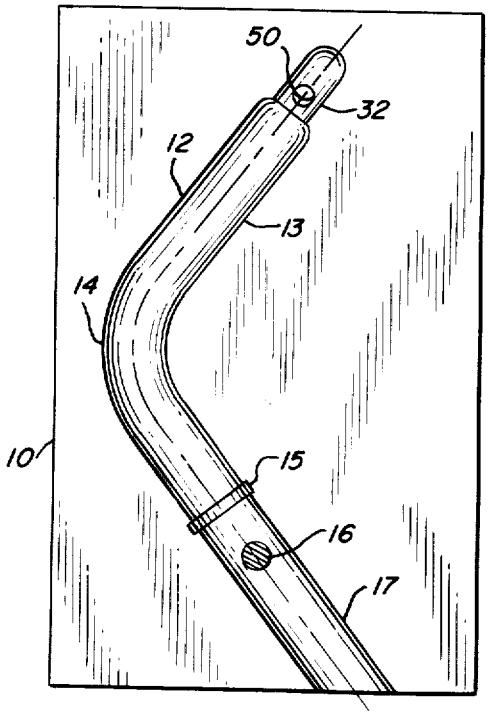
FIG. 1
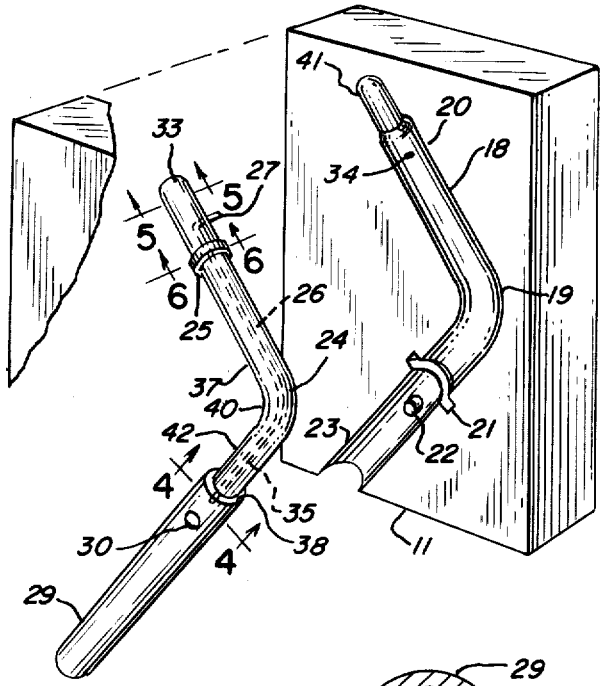
FIG. 3
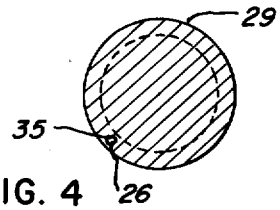
FIG. 4
FIG. 8
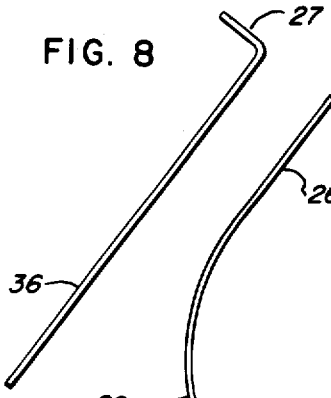
FIG. 7
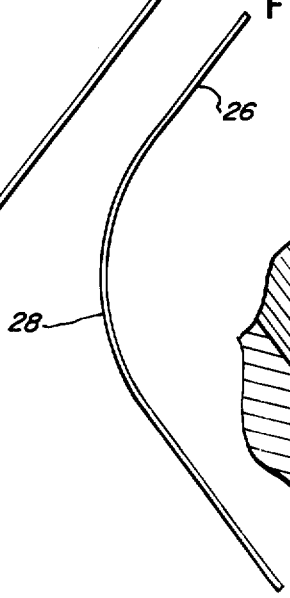
FIG. 9
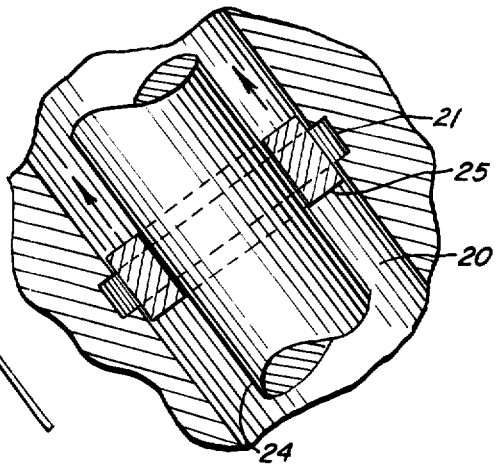
FIG. 5
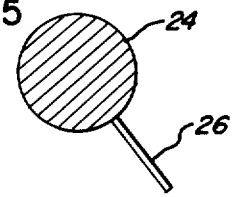
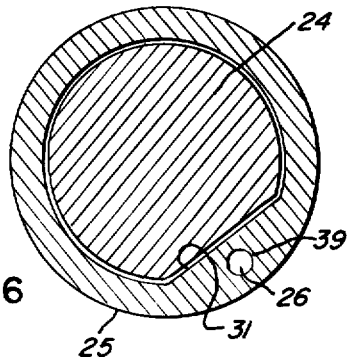
FIG. 6

TUBE MOLD

Conventional extrusion and molding techniques generally have not been entirely satisfactory for the production of thin-walled, multi-lumen tubing. It has been particularly difficult to prepare arcuate, multi-lumen tubing having a secondary lumen within the tube wall. Lack of dimensional control of wall thickness often resulted in the secondary lumen breaking out from the tube wall, thus rendering useless that section of tubing. That problem is particularly acute during the production of arcuate tubing.

In order to correct the above-noted deficiencies in prior art processes, a tube molding apparatus having a core follower system to produce accurately dimensioned thin wall, optionally multi-lumen, tubes is described.

The invention is illustrated with reference to the following drawings; wherein:

FIG. 1 is a perspective view of the top plate of the mold apparatus;

FIG. 2 is a top view of the bottom plate of the mold apparatus;

FIG. 3 is a view of the core insert with the core follower retained thereon;

FIG. 4 is a section view along line 4–4 of FIG. 3;

FIG. 5 is a section view along line 5—5 of FIG. 3;

FIG. 6 is a section view along line 6—6 of FIG. 3;

FIG. 7 is a view of a second core insert utilized in a preferred embodiment of this invention;

FIG. 8 is a side view of the wire of FIG. 7; and

FIG. 9 is an enlarged view, partially in section of the core follower mounted on the core insert within the core of the mold.

The invention will be described with reference to FIGS. 1-9, wherein a preferred embodiment of the instant invention utilized to manufacture a double lumen tube is described. However, it will be recognized that the mold and method described herein are useful for producing single lumen tubes or multiple lumen tubes, or a plurality of single or multiple lumen tubes in one operation. The following description, then, is not meant to limit the invention but is merely illustrative thereof.

FIGS. 1 and 2 illustrate representative bottom and top plates, 10 and 11 respectively, which, when made to overlay one another, form the mold body. Bottom plate 10, of substantially rectangular configuration, has formed, in the top surface thereof, a channel 13 comprising a relatively straight portion 12 and arcuate portion 14, and another relatively straight portion 17. Channel portion 17 is of appropriate dimension to receive portion 29 of core insert 24 as shown in FIG. 3. Locating hole 16 and locating hole 30 are provided to assist location of core insert 24 into channel 13. Channel 13 also has portion 32 which is of appropriate dimension to receive end 33 of core insert 24.

Upper plate 11 has a channel 20 formed therein corresponding to channel 13 of bottom plate 10. However, channel 20 is arranged on top plate 11 such that when top plate 11 in inverted and made to overlay bottom plate 10, channels 13 and 20 form a cavity which can be utilized as a mold core. Channel 20 comprises straight portions 18 and 23 and arcuate portion 19. Locating hole 22 is provided so that core insert 24 may be appropriately positioned. Also provided is end portion 41 which is dimensioned to receive end 33 of core insert 24. In the preferred embodiment of this invention mold plates 10 and 11 are provided with channels 13 and 20 having enlarged portions 15 and 21. Portions 15 and 21 provide a lip on the finished tube product, which is utilized as described hereinafter to retain the formed tube in a corresponding female fitting during clinical use. There further is provided in top channel 13, a hole 34 which is dimensioned to receive end 27 of wire 26.

With reference to FIG. 3, core insert 24 is provided with a handle portion 29 having a locating hole 30 formed therein. Optionally a pin, not shown, can be permanently affixed in hole 30 for location of insert 24 in the mold by insertion of the pin into locating holes 16 and 22. Handle 29 is provided additionally with an opening 35 which is adapted to receive the end portion 36 of wire 26, most clearly shown in FIGS. 3-4. Core insert 24 comprises straight portions 37 and 42 and arcuate portion 40, which are adapted to correspond to the straight and arcuate portions of channels 13 and 20. Core insert 24 is of diametral dimensions less than those of channel 13 and 20 such that when core insert 24 is placed within channels 13 and 20, core insert 14 is spaced from the wall of the cavity formed by said channels.

Within the space provided between core insert 24 and the cavity formed by channels 13 and 20, there is placed a core follower 25, most clearly shown in FIGS. 3 and 6, which is operable to slidably move along core insert 24 and within channels 13 and 20 from a first position, whereat polymer injection is initiated, to a second position defined by end 38 of handle portion 29. When polymer injection is initiated at the first position, fluid polymer flows into the cavity behind core follower 25 and forces core follower 25 along core insert 24. At each point along the path, core follower 25 acurately positions and retains core insert 24 within the cavity formed by channels 13 and 20. Thus, very accurately sized tube walls are obtained. Furthermore, as the preferred embodiment has been illustrated by the formation of arcuate tubing, core follower 25 is able to move along and around the arcuate portion 40 of core insert 24. Thus a very simple method of manufacturing curved tubing having a thin wall is provided.

Core follower 25 is shaped at its outer circumference to correspond to the shape of channels 13 and 20 and shaped at its interior circumference to correspond to the shape of core insert 24.

In the preferred embodiment of this invention as illustrated by the drawings, core follower 25 is annular and is provided with a hole 39 in a portion thereof. Hole 39 is appropriately sized to receive wire 26, as can be clearly seen in FIGS. 3 and 6. Wire 26 has straight portions 36 and an arcuate portion 28, which correspond to the straight and arcuate portions of channels 13 and 20 and core insert 24, and functions to provide an inflation lumen in the tube wall. The end portion 27 of wire 26 is designed to be inserted into hole 34 at the bottom of channel 20 and the end portion 36 of wire 26 is designed to be inserted into hole 35 provided in end portion 38 of handle 29. In operation, core follower 25 is first placed upon core insert 24 and wire 26. End portion 27 of wire 26 is placed at a first position, defined by hole 34 in channel 20, and core insert 24 having core follower 25 mounted thereon, (utilizing locating holes 30 and 16) is placed in channel 20. Then top plate 11 is inverted and made to overlay bottom plate 10 such that locating hole 22 coincides with locating hole 16 and 30. The entire mold thus comprises a body having a core formed by channels 13 and 20, a core insert 24 held in a spaced relationship from the closed surface formed by channels 13 and 20, a second core insert 26 held in a spaced relationship from said closed surface and a core follower 25 retained about said core insert 24 and within a closed surface formed by channels 13 and 20. An injection port 50, is provided at the downstream end of channels 13 and 20 between hole 34 and end portions 32 and 41 of channels 13 and 20. As the polymer is injected into the cavity formed by channels 13 and 20, core follower 25 proceeds from its first position adjacent hole 34 at the downstream end of channels 13 and 20 to a second position at the upstream end of channels 13 and 20 abutting end 38 of handle 29. At each position during its travel core follower 25 has accurately positioned the relative spacial configurations of core insert 24 and lumen wire 26 in the cavity formed by channels 13 and 20. Upon removal from the mold, lumen wire 26 is easily removed by pulling linearly on end 27, and core insert 24 is removed by stripping the formed tube off the outer surface of core insert 24.

It is apparent that multiple channels 13 and 20 can be placed in appropriately machined bottom and top plates 10 and 11 so that a plurality of tubes can be manufactured in one operation. Furthermore, although the invention has been illustrated by production of arcuate shaped tubing, it is apparent that other shapes can be produced as well. Although only a double lumen tube has been illustrated, it is intended to apply also to multiple lumen tubes wherein a plurality of lumen wires 26 would be placed above core insert 24 and retained in a space configuration therefrom by an appropriate core follower 25. The number of lumens able to be retained in the wall, thus, is limited only by the circumference of the tube itself and the available volume of the tube wall.

I claim:

1. A molding apparatus comprising:

a. a bottom plate having a first groove therein;

b. a top plate having a second groove therein and overlaying said bottom plate such that said first groove and said second groove define a cavity, said cavity having a downstream end and an upstream end;

c. first core means removably mounted within said cavity and in a spaced relationship from the walls of said cavity;

d. annular means disposed between the walls of said cavity and said first core; and e. an injection port at said downstream end of said cavity between said annular means and said downstream end whereat material injection is initiated, said annular means being slidable by means of said injection fluid along said core from a first position adjacent said injection port to a second position remrote from said first position in the direction of the upstream end of said cavity.

2. A molding apparatus as in claim 1 further comprising a second core means adapted for placement between said first core means and said cavity in a spaced relationsip therefrom.

3. A molding apparatus as in claim 2 wherein said second core means is positioned by said annular means and said annular means is slidable simultaneously along said first core means and said second core means from said first position to said second position by said injection material.

4. A molding apparatus comprising:

a. a body having a cavity therein, said cavity having an upstream end and a downstream end;

b. first core means removably mounted within said cavity in a spaced relationship from the walls of said cavity;

c. annular means diposed within said cavity about said core; and d. an injection port at said downstream end of said cavity between said annular means and said downstream end whereat material injection is initiated, said annular means being slidable by means of said injection fluid along said core at a first position adjacent said injection port to a second position remote from said first position in the direction of the upstream end of said cavity.

5. A molding apparatus as in claim 4 further comprising a second core means adapted for placement between said first core means and the walls of said cavity in a spaced relationship therefrom.

6. A molding apparatus as in claim 5 wherein said second core means is supported by said annular means and said annular means is slidable simultaneously along said first core means and said second core means from said first position to said second position.

7. A molding apparatus as in claim 4 wherein said cavity has a first substantially straight portion, a second substantially arcuate portion, and a third substantially straight portion and said core means has a first substantially straight portion, a second substantially arcuate portion, and a third substantially straight portion corresponding to said first, second and third portions of said channel.

* * * * *